US008834651B2

(12) United States Patent
Matsumura et al.

(10) Patent No.: US 8,834,651 B2
(45) Date of Patent: Sep. 16, 2014

(54) METHOD OF PRODUCTION AND PRODUCTION FACILITY OF HIGH STRENGTH COLD ROLLED STEEL SHEET EXCELLENT IN CHEMICAL CONVERTIBILITY

(75) Inventors: Kenichiro Matsumura, Tokyo (JP); Kohji Yanaba, Tokyo (JP); Yuuki Yasuda, Tokyo (JP)

(73) Assignee: Nippon Steel & Sumitomo Metal Corporation, Tokyo (JP)

( * ) Notice: Subject to any disclaimer, the term of this patent is extended or adjusted under 35 U.S.C. 154(b) by 681 days.

(21) Appl. No.: 12/520,229

(22) PCT Filed: Jan. 9, 2008

(86) PCT No.: PCT/JP2008/050471
§ 371 (c)(1),
(2), (4) Date: Jun. 19, 2009

(87) PCT Pub. No.: WO2008/084875
PCT Pub. Date: Jul. 17, 2008

(65) Prior Publication Data

US 2009/0308498 A1 Dec. 17, 2009

(30) Foreign Application Priority Data

Jan. 9, 2007 (JP) ..... 2007-000990

(51) Int. Cl.
*C23C 8/10* (2006.01)
*C23C 2/02* (2006.01)
(Continued)

(52) U.S. Cl.
CPC . *C23C 22/78* (2013.01); *C23C 2/02* (2013.01); *C22C 38/001* (2013.01); *C21D 9/573* (2013.01); *C22C 38/06* (2013.01); *C21D 9/46* (2013.01); *C22C 38/04* (2013.01); *C22C 38/02* (2013.01)
USPC ..... 148/284; 148/508

(58) Field of Classification Search
CPC ..... C23C 8/10; C21D 11/00; C21D 8/02
USPC ..... 266/103, 111, 113, 127; 148/284, 508
See application file for complete search history.

(56) References Cited

U.S. PATENT DOCUMENTS 5,131,126 A 7/1992 Katsuki et al.
5,554,235 A * 9/1996 Noe et al. ..... 148/610
(Continued)

FOREIGN PATENT DOCUMENTS

JP 55-145122 A 11/1980
JP 58-96823 A 6/1983
(Continued)

OTHER PUBLICATIONS

NPL: Machine translation of JP10317188A, Dec. 1998.*

*Primary Examiner* — Jie Yang
(74) *Attorney, Agent, or Firm* — Birch, Stewart, Kolasch & Birch, LLP

(57) ABSTRACT

A method using a continuous annealing furnace where a cooling method of a cooling zone including part or all of the temperature range of the steel sheet of 600 to 250° C. following the heating for recrystallization is one or more of gas cooling, effusion cooling, and cooling pipe cooling, or a joint cold rolled steel sheet/hot dip galvanized steel sheet facility having such a continuous annealing furnace, to continuously anneal cold rolled steel sheet to produce high strength cold rolled steel sheet, characterized by exposing the steel sheet surface to an iron-oxidizing atmosphere in the steel sheet temperature range to make the surface oxidize, pickling the sheet at the outlet side of the annealing furnace, then iron- or Ni-plating the sheet to 1 to 50 mg/m$^2$.

4 Claims, 13 Drawing Sheets

(51) Int. Cl.

| | |
|---|---|
| ***C22C 38/00*** | (2006.01) |
| ***C21D 9/573*** | (2006.01) |
| ***C22C 38/06*** | (2006.01) |
| ***C21D 9/46*** | (2006.01) |
| ***C22C 38/04*** | (2006.01) |
| ***C23C 22/78*** | (2006.01) |
| ***C22C 38/02*** | (2006.01) |

(56) References Cited

U.S. PATENT DOCUMENTS

| | | | | |
|---|---|---|---|---|
| 6,398,884 | B1 | 6/2002 | Kyono et al. | |
| 6,517,955 | B1 * | 2/2003 | Takada et al. | 428/659 |
| 6,797,410 | B2 * | 9/2004 | Ishii et al. | 428/659 |
| 7,193,189 | B2 * | 3/2007 | Blumenthal et al. | 219/497 |

FOREIGN PATENT DOCUMENTS

| | | | | |
|---|---|---|---|---|
| JP | 63-11623 | A | | 1/1988 |
| JP | 4-6288 | A | | 1/1992 |
| JP | 7-97616 | A | | 4/1995 |
| JP | 10317188 | A | * | 12/1998 |
| JP | 2000-309824 | A | | 11/2000 |
| JP | 2005-307283 | A | | 11/2005 |

* cited by examiner

METHOD OF PRODUCTION AND PRODUCTION FACILITY OF HIGH STRENGTH COLD ROLLED STEEL SHEET EXCELLENT IN CHEMICAL CONVERTIBILITY

TECHNICAL FIELD

The present invention relates to a method of production able to produce a high strength cold rolled steel sheet excellent in chemical convertibility even when increasing the contents of Si, Mn, etc. along with the increase in strength and a production facility for realizing the same.

BACKGROUND ART

In the past, when producing high strength cold rolled steel sheet, a continuous annealing furnace facility charging inert gas into a furnace atmosphere (see FIG. 11) or a joint cold rolled steel sheet/hot dip galvanized steel sheet facility having such a continuous annealing furnace (see FIG. 12) has been used.

In the continuous annealing furnace facility shown in FIG. 11, in general, cooling using water such as mist cooling and water dip cooling, gas cooling spraying cooled atmosphere gas and/or roll cooling which cools by contact with a cooling medium running through the inside are/is used for the cooling zone.

The joint cold rolled steel sheet/hot dip galvanized steel sheet facility having the continuous annealing furnace shown in FIG. 12 has a plating facility (in the figure, see hot dip galvanization pot 8 and pass line $L_2$). At the time of production of hot dip galvanized steel sheet, the general practice is to maintain the plating adhesion by using gas cooling spraying a cooled atmospheric gas.

Further, in a joint cold rolled steel sheet/hot dip galvanized steel sheet facility having such a continuous annealing furnace, when annealing a non-hot dip galvanized cold rolled steel sheet, as shown by the broken line in FIG. 12, the cold rolled steel sheet passes through a detachable type pass line $L_1$ cut off from the outside air in the same way as another furnace.

In the facility, when annealing mild steel sheet (for example, Si: 0.2% or less), the chemical convertibility did not particularly become a problem.

However, to improve the strength along with the increase in strength of steel sheet due to the need for reducing weight in the automobile field, the amounts of the strength-improving elements Si, Mn, etc. added have been increased. If for example increasing Si to about 1.0%, the steel sheet surface is left with large amounts of Si, Mn, or other oxide films, the chemical convertibility deteriorates, and parts of the Si oxide film not chemically converted, that is, chemical conversion defects called "bald spots", occur.

In a continuous annealing furnace facility using mist cooling or water dip cooling or another cooling method using water for the cooling zone including part or all of the range of steel sheet temperature of 600 to 250° C. following the heating for recrystallization, the steel sheet surface is exposed to water at the steel sheet temperature, so the steel sheet is pickled or Ni-plated when the steel sheet leaves the annealing furnace.

For this reason, even in high strength cold rolled steel sheet increased in Si or Mn, the chemical convertibility did not particularly become a problem.

However, in a continuous annealing furnace using gas cooling, effusion cooling, and cooling pipe cooling without using a cooling method using water for the cooling method of the cooling zone including part or all of the temperature range or a joint cold rolled steel sheet/hot dip galvanized steel sheet facility having such a continuous annealing furnace, the furnace is filled with an inert atmosphere gas and the oxygen concentration and the dew point are extremely low, so in conventional low Si and Mn materials, the extent of the oxide film does not become a problem. There is normally no facility pickling or Ni-plating steel sheets when it leaves an annealing furnace.

As a result, remarkable deterioration of the chemical convertibility occurs due to the shift to high Si and Mn high strength steel sheet.

In addition, "gas cooling" means the cooling method of cooling by spraying the steel sheet in the furnace by an atmospheric gas of a lower temperature than the steel sheet temperature, "effusion cooling" means the cooling method of cooling by passing the steel sheet through a furnace to which an atmospheric gas of a lower temperature than the steel sheet temperature is supplied, and "cooling pipe cooling" means the cooling method of cooling steel sheet by running a cooling medium through pipes arranged in the furnace and cut off from the furnace atmospheric gas and cooling the furnace atmospheric gas.

Further, a continuous annealing furnace or a joint cold rolled steel sheet/hot dip galvanized steel sheet facility having such a continuous annealing furnace described in the Description includes a continuous annealing furnace of a continuous annealing facility of steel sheet, a continuous annealing furnace of a hot dip galvanization facility of steel sheet, and a continuous annealing furnace of a joint cold rolled steel sheet/hot dip galvanized steel sheet facility.

For this reason, even in a continuous annealing furnace where the cooling method of the cooling zone including part or all of the above-mentioned temperature range is one or more of gas cooling, effusion cooling, and cooling pipe cooling or a joint cold rolled steel sheet/hot dip galvanized steel sheet facility having such a continuous annealing furnace, as shown in FIG. 13 or FIG. 14, the steel sheet is pickled or Ni-plated when it leaves the annealing furnace so as to avoid the formation of "bald spots" and restore the chemical convertibility to the conventional level.

Further, Japanese Patent Publication (A) No. 2006-45615 proposes a method of once oxidizing a steel sheet surface, then reducing it in a reducing atmosphere to prevent deterioration of the chemical convertibility without pickling or Ni-plating after annealing.

DISCLOSURE OF THE INVENTION

However, in recent years, the need for increasing strength has become higher. The amount of Si, Mn or other strength-improving elements was therefore been further increased. For example, Si is added up to 1.0 to 2.0%.

This being the case, in a continuous annealing furnace where the cooling method of the cooling zone including part or all of the above temperature range is one or more of gas cooling, effusion cooling, or cooling pipe cooling or a joint cold rolled steel sheet/hot dip galvanized steel sheet facility having such a continuous annealing furnace, "bald spots" occurs due to chemical conversion even if pickling and Ni-plating the steel sheet when it leaves the annealing furnace.

The inventors investigated the cause, whereupon they learned that it was again due to the Si or Mn oxide film remaining on the steel sheet surface. Therefore, to remove the residual Si or Mn oxide film, the practice has been to strengthen the pickling of the sheet when leaving the annealing furnace, specifically, to lower the running rate from 100 mpm to 30 mpm and to raise the pickling temperature from 70° C. to 80° C., but the Si or Mn oxide film continued to remain and "bald spots" remained and became a problem in chemical conversion.

Furthermore, as the method for strengthening the pickling, while usually there was a single pickling tank where the sheet left the annealing furnace, the means of increasing this to a plurality of tanks was left, but already the running rate was lowered to the extremely low rate of 30 mpm. Even if securing enough dipping time in the pickling tank, it is not possible to expect any great recovery in the running rate due to the "bald spots" remaining. Further, there were major problems such as the costs of the facilities or the installation space.

Further, this tendency becomes remarkable when the Si is 1.0% or more, particularly over 1.1% and/or Mn is 2.0% or more, particularly over 2.2%.

The present invention solves the above problems and has as its object the provision of a method and facility able to produce high strength cold rolled steel sheet excellent in chemical convertibility even with a high content of Si or Mn in the steel sheet when using a continuous annealing furnace where a cooling method of a cooling zone including part or all of the temperature range of the steel sheet of 600 to 250° C. following the heating for recrystallization is one or more of gas cooling, effusion cooling, and cooling pipe cooling, or a joint cold rolled steel sheet/hot dip galvanized steel sheet facility having such a continuous annealing furnace, for continuous annealing.

The inventors engaged in in-depth studies to solve the above problem and as a result discovered that instead of forming an inert gas atmosphere of an extremely low concentration oxygen (for example, tens to several ppm) and/or extremely low dew point (for example, −20 to −60° C.) around the steel sheet in the temperature range of the steel sheet in a continuous annealing furnace where the cooling method of the cooling zone including part or all of the temperature range of the steel sheet mentioned above is one or more of gas cooling, effusion cooling, or cooling pipe cooling, or a joint cold rolled steel sheet/hot dip galvanized steel sheet facility having such a continuous annealing furnace, so as to prevent oxidation of steel sheet, by deliberately forming an oxidizing atmosphere, oxidizing the Si and Mn and furthermore the iron in the steel sheet, and pickling and removing the Si or Mn or other oxide film together with the iron oxide film by the pickling when the sheet leaves the annealing furnace, it is possible to obtain high strength cold rolled steel sheet excellent in chemical convertibility free of "bald spots" even if the contents of Si, Mn, etc. are high.

The conditions of the steel sheet surface according to the prior art and the present invention are schematically shown in FIG. 1.

FIG. 1(*a*) to (*c*) show the surface conditions of conventional steel sheet, while FIG. 1(*d*) shows the surface conditions of steel sheet of the present invention.

FIG. 1(*a*) shows the surface conditions of steel sheet in the case of chemically converting 25 steel sheet S with little Si and Mn. As shown in FIG. 1(*a*), since the steel sheet S contains little Si and Mn, chemical conversion 25 causes the formation of chemically converted film crystals 25*a* free of "bald spots" on the surface of the steel sheet S.

FIG. 1(*b*) shows the surface conditions of steel sheet in the case of chemically converting 25 steel sheet S with large amounts of Si and Mn. As shown in FIG. 1(*b*), since the steel sheet S contains large amounts of Si and Mn, the surface of the steel sheet S has Si and Mn oxide films Sa. If chemically converted 25, chemically converted film crystals 25*a* free of "bald spots" X are formed.

FIG. 1(*c*) shows the surface conditions of steel sheet in the case of pickling 26, then chemically converting 25 steel sheet containing further more Si and Mn. As shown in FIG. 1(*c*), since the steel sheet S further contains Si and Mn, the surface of the steel sheet S has thick Si and Mn oxide films Sa. Even if pickling 26, they cannot be completely removed. If next chemically converting 25 the sheet, chemically converted film crystals 25*a* free of bald spots X are formed.

FIG. 1(*d*) shows the surface conditions of steel sheet according to the present invention. As shown in FIG. 1(*d*), if steel sheet S contains further higher Si and Mn, the surface of the steel sheet S will have thick Si and Mn oxide films Sa, but the steel sheet surface is deliberately oxidized 27 in an oxidizing atmosphere to form an iron oxide film 27*a* covering the Si and Mn oxide film Sa and the Si and Mn oxide films Sa are removed together with the iron oxide film 27*a* by the pickling 26. Simultaneously, the fine oxides (iron oxides etc.) forming the nuclei for precipitation of chemically converted film crystals are also removed resulting in surface conditions under which formation of a chemically converted film is difficult, so next the surface is iron- or Ni-plated 28 to form an iron- or Ni-plating film 28*a*. When next chemically converting 25 the sheet, it is possible to form chemically converted film crystals 25*a* free of bald spots X on the iron- or Ni-plating film 28*a*.

The present invention was made based on the above findings. The method of production of a high strength cold rolled steel sheet excellent in chemical convertibility of embodiment 1 comprises using a continuous annealing furnace where a cooling method of a cooling zone including part of all of a temperature range of the steel sheet of 600 to 250° C. following heating for recrystallization is one or more of gas cooling, effusion cooling, and cooling pipe cooling, or a joint cold rolled steel sheet/hot dip galvanized steel sheet facility having such a continuous annealing furnace, to continuously anneal cold rolled steel sheet in which case exposing the surface of the steel sheet in the steel sheet temperature range to an iron-oxidizing atmosphere so as to make it oxidize, pickling the sheet at the annealing furnace outlet side, then iron- or Ni-plating the sheet to 1 to 50 mg/m$^2$.

In this case, the oxidation state can be formed by making the steel sheet run outside the furnace.

Further, the method of production of a high strength cold rolled steel sheet excellent in chemical convertibility of embodiment 2 comprises using a continuous annealing furnace where a cooling method of a cooling zone including part of all of a temperature range of the steel sheet of 600 to 250° C. following heating for recrystallization is one or more of gas cooling, effusion cooling, and cooling pipe cooling, or a joint cold rolled steel sheet/hot dip galvanized steel sheet facility having such a continuous annealing furnace, to continuously anneal cold rolled steel sheet and produce high strength cold rolled steel sheet in which case supplying the inside of the furnace in the steel sheet temperature range with atmospheric gas containing oxygen or water vapor, measuring the oxygen concentration or dew point in the furnace, controlling the amount of supply of the atmospheric gas containing the oxygen or water vapor from the measurement results, pickling the sheet at the annealing furnace outlet side, then iron- or Ni-plating it to 1 to 50 mg/m$^2$.

The method of production of a high strength cold rolled steel sheet excellent in chemical convertibility of embodiment 3 is characterized by making the steel sheet run outside of the furnace so as to expose the surface of the steel sheet to an iron oxidizing atmosphere at part or all of the 600 to 250°

C. steel sheet temperature range following heating for recrystallization, then pickling the sheet at the annealing furnace outlet side, then iron- or Ni-plating it to 1 to 50 mg/m$^2$.

Furthermore, as described in embodiment 4, when Si is 1.0 to 2.0% and/or Mn is 2.0 to 3.0%, the effect of the present invention remarkably appears.

Further, a production facility of a high strength cold rolled steel sheet excellent in chemical convertibility of embodiment 5 comprises a continuous annealing furnace where a cooling method of a cooling zone including part of all of a temperature range of the steel sheet of 600 to 250° C. following heating for recrystallization is one or more of gas cooling, effusion cooling, and cooling pipe cooling, or a joint cold rolled steel sheet/hot dip galvanized steel sheet facility having such a continuous annealing furnace, provided with a facility supplying oxygen or water vapor in the steel sheet temperature range to an ambient atmosphere of the steel sheet and provided, at an annealing furnace outlet side, with a pickling facility and iron- or Ni-plating facility.

Here, the facility for supplying oxygen or water vapor may be made a facility for running the steel sheet outside the furnace to bring it into contact with the outside air.

Furthermore, the production facility of a high strength cold rolled steel sheet excellent in chemical convertibility of embodiment 6 comprises a continuous annealing furnace where a cooling method of a cooling zone including part of all of a temperature range of the steel sheet of 600 to 250° C. following heating for recrystallization is one or more of gas cooling, effusion cooling, and cooling pipe cooling, or a joint cold rolled steel sheet/hot dip galvanized steel sheet facility having such a continuous annealing furnace, provided with a facility supplying oxygen or water vapor in the steel sheet temperature range to an ambient atmosphere of the steel sheet, provided with a control apparatus having a facility measuring an oxygen concentration or dew point in the furnace and controlling the amount of supply of atmospheric gas containing oxygen or water vapor from the measurement results, and provided, at an annealing furnace outlet side, with a pickling facility and iron- or Ni-plating facility.

The present invention, based on the novel idea of deliberately exposing steel sheet to an oxidizing atmosphere in a cooling zone usually held in a reducing atmosphere, oxidizing the Si and Mn and furthermore the Fe on the steel sheet surface, then removing the Si or Mn or other oxide film together with the iron oxide film on the steel sheet surface by the pickling performed when the sheet leaves the annealing furnace, enables the production of high strength cold rolled steel sheet excellent in chemical convertibility even if the contents of Si or Mn etc. of the steel sheet are high in a continuous annealing furnace where a cooling method of a cooling zone including part of all of a temperature range of the steel sheet of 600 to 250° C. following heating for recrystallization is one or more of gas cooling, effusion cooling, and cooling pipe cooling, or a joint cold rolled steel sheet/hot dip galvanized steel sheet facility having such a continuous annealing furnace.

BEST MODE FOR CARRYING OUT THE INVENTION

The present invention deliberately exposes the steel sheet to an oxidizing atmosphere to make not only the Si and Mn, but also the iron at the steel sheet surface oxidize and removes the Si or Mn or other oxide film together with the iron oxide film at the steel sheet surface by the pickling when leaving the annealing furnace, by soaking from the heating of the annealing, then oxidizing the steel sheet at the cooling zone. Specifically, in the middle of the cooling after the heating for recrystallization, it exposes the steel sheet surface to an Fe-oxidizing atmosphere at a range of steel sheet temperature of 250 to 600° C.

In the present invention, the application of one or more of cooling methods not using water such as gas cooling, effusion cooling, and cooling pipe cooling in the cooling zone, in particular the cooling zone including part or all of the temperature range of the steel sheet of 600 to 250° C. following the heating for recrystallization is the major characteristic.

With mist cooling or water dip cooling, the steel sheet ends up being directly exposed to water, while with gas cooling, effusion cooling, and cooling pipe cooling, not exposing the steel sheet surface to atmospheric gas or outside air with a high oxygen or dew point was common sense, while in the present invention, it is important to expose the steel sheet surface to a high oxygen or dew point atmosphere.

The "iron-oxidizing atmosphere" means an atmosphere in a state where iron oxidizes based on the equilibrium state chart determined thermodynamically in the temperature range of the steel sheet (for example, Zairyo Kankyogaku Nyumon, Association of Corrosion Engineers ed., p. 203, Maruzen, 1993).

Figure 1:
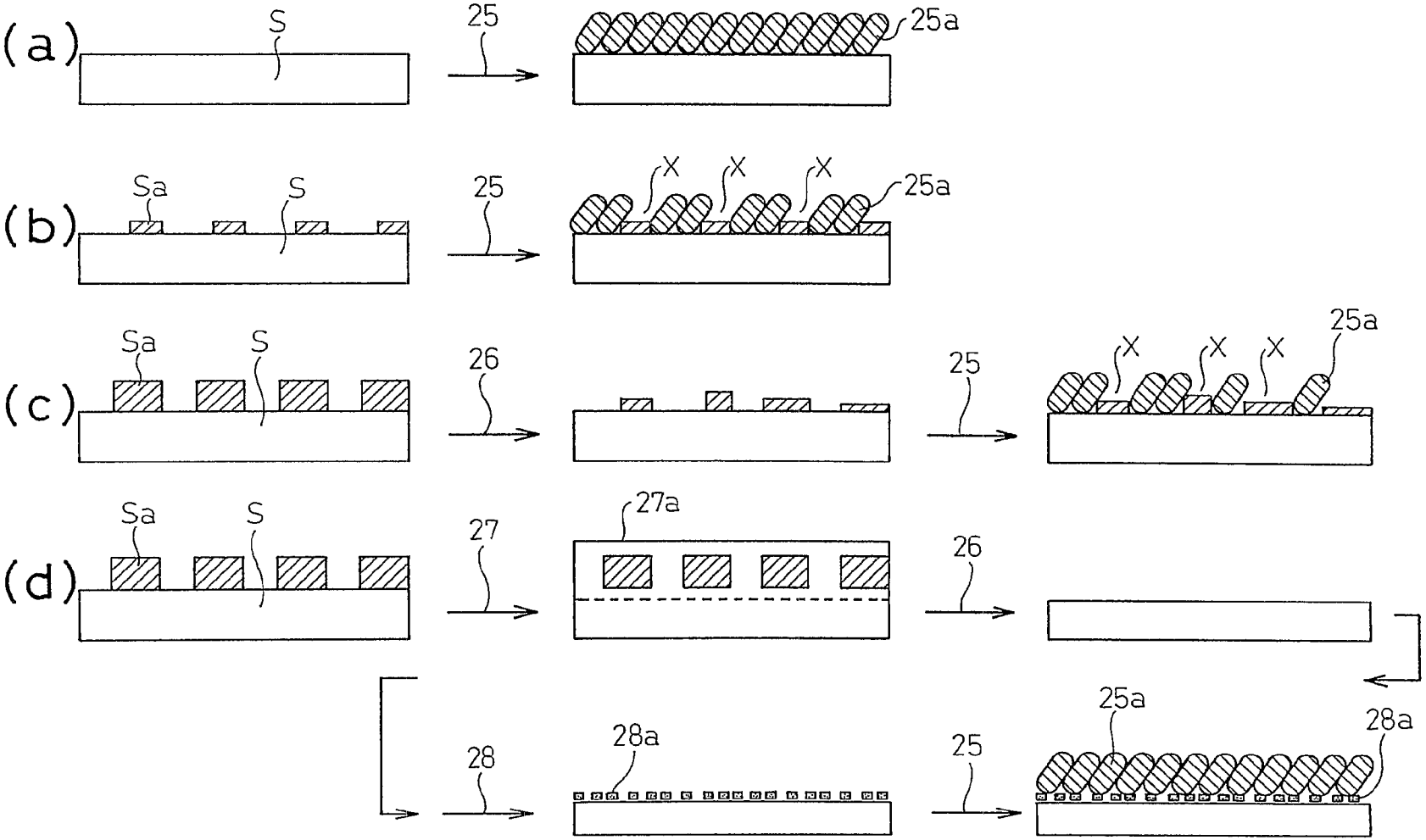
FIG. 1 is a view showing the states of the surfaces of the steel sheets according to the prior art and the present invention. (a) to (c) show the state of the surface of the steel sheet according to the prior art, while (d) shows the state of the surface of the steel sheet according to the present invention.
Figure 2:
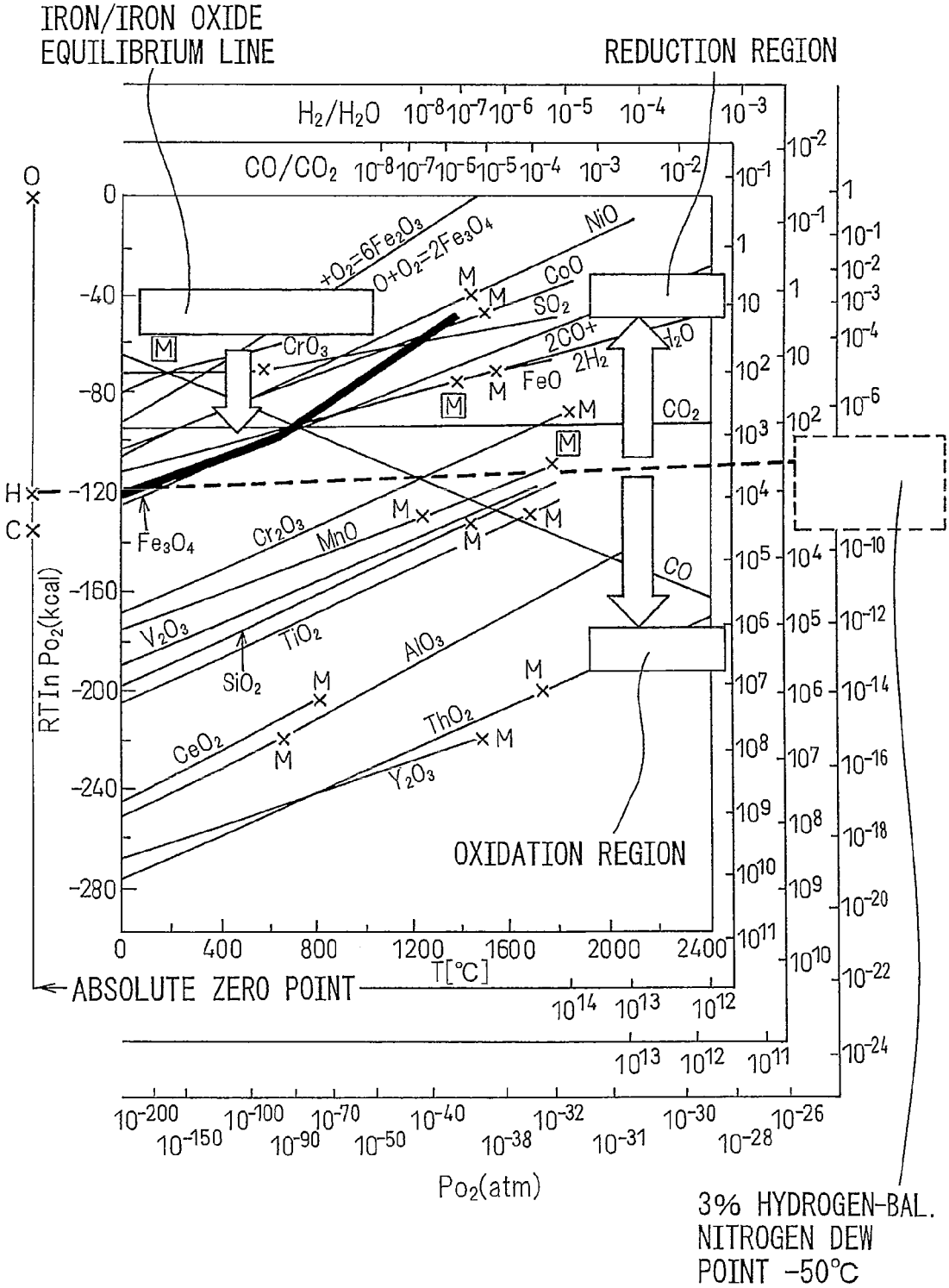
FIG. 2 is a view showing an oxidation region of iron.

In FIG. 2, for example, the oxygen potential under an atmosphere of 3% hydrogen-bal. nitrogen and dew point of −50° C. is on the broken line. When the oxygen potential of a certain element is positioned above this broken line, the element maintains the reduced state. Further, when positioned below this broken line, the element maintains the oxidized state.

Specifically, the iron/iron oxide equilibrium line is positioned above the broken line in the region of about 50° C. or more, so in this range, the iron is present in a reduced state, that is, as metallic iron.

Further, Si, as shown in FIG. 2, is positioned below the broken line in the entire temperature range. Under these conditions, this is present in an oxidized state, that is, as $SiO_2$.

Figure 3:
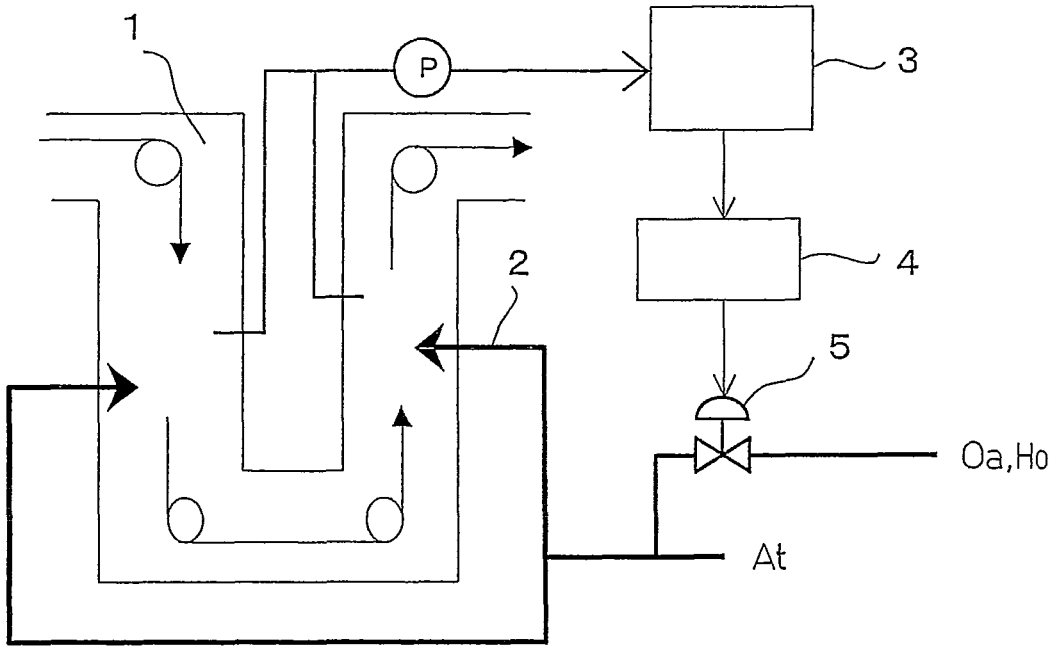
FIG. 3 is a view showing a gas supply facility.

As a method for exposing the steel sheet under an iron-oxidizing atmosphere, for example, as shown in FIG. 3, it is possible to install a gas supplying facility 2 at the jet cooling furnace 1 and supply oxygen or air Oa together with the cooling atmospheric gas At or supply water vapor Ho to raise the dew point. In this case, it is preferable to sample the gas from the furnace by an oxygen concentration meter or dew point meter 3, send the measurement results to the control apparatus 4, operate the valve 5 of the gas charging facility 2, manage the oxygen partial pressure, water partial pressure, and further hydrogen partial pressure, and maintain the oxidized state of the iron.

If the steel sheet temperature for oxidizing the iron is less than 250° C., the oxidation will not proceed. Further, if over 600° C., the oxidation of the iron will proceed too much and the load in the pickling for removing the iron oxides will become larger. Further, the iron oxide drops off, sticks to the conveyor rolls in the furnace, and leads to quality defects of the steel sheet surface. For this reason, the steel sheet temperature for oxidizing the iron is preferably 250° C. to 600° C., from the viewpoint of temperature management in the operation, is more preferably 300° C. to 500° C.

In addition, in the cooling zone of the present invention, if the cooling rate is 1° C./s or more, there is no particular need to define it. Slow cooling or effusion cooling called "temperature holding" or "holding" in the averaging furnace is also possible.

Further, the cooling zone of the present invention should be a cooling zone using one or more of gas cooling, effusion cooling, and cooling pipe cooling and including part of all of the temperature range of the steel sheet of 600 to 250° C. following heating for recrystallization. Further, if exposing the steel sheet to an oxidizing atmosphere in the steel sheet temperature range, the effect of the present invention is obtained.

Further, even with reheating of the steel sheet in the middle of cooling following heating, there is no problem if the reheating temperature of the steel sheet is in the range of 600 to 250° C. or the reheating is performed in an inert gas atmosphere.

Regarding the pickling conditions for pickling and removing the Si or Mn or other oxide film together with the iron oxide film of the steel sheet surface when leaving the annealing furnace, the type of acid is not particularly limited, but hydrochloric acid or sulfuric acid is preferable. The concentration of the acid is preferably 1 to 20 wt %. If less than 1 wt %, the pickling effect is poor. In particular, with just one pickling tank used for a pickling facility when leaving the annealing furnace, the oxide film cannot be completely removed.

Further, if the concentration of the acid is over 20 wt %, the pickling effect ends up being saturated and the effect of the cost increase becomes greater, so this is not preferable.

The solution temperature of the pickling tank is preferably 60 to 95° C. If less than 60° C., in the same way as the concentration, the oxide film cannot be completely removed. If over 95° C., the pickling effect ends up being saturated. This is not preferable in that the effect of the increase in the cost of energy used for raising the temperature becomes greater.

After pickling, the sheet is iron- or Ni-plated to 1 to 50 $mg/m^2$. This is because pickling makes the steel sheet surface too beautiful, the nuclei for precipitation of chemically converted crystals are lost, and the chemical convertibility deteriorates.

The deterioration in chemical convertibility appears as a phenomenon where locations called "bald spots" where the film does not partially deposit occur or the phenomenon where the phosphophyllite ($Zn_2Fe(PO)_2.4H_2O$) crystallizing and precipitating at the steel sheet material will not precipitate.

The former phenomenon can be confirmed by observation by an electron microscope. It is important that the iron- or Ni-plating be uniformly deposited over the entire surface.

The latter phenomenon is confirmed by calculating the P ratio showing the ratio of crystallization of phosphophyllite from the X-ray diffraction intensity. In general, P ratio≥0.80 is sought for satisfying the corrosion resistance or coating performance. Further, in regions using melting-snow salt and other extremely corrosive environments, P ratio≥0.85 is sought.

The amount of iron- or Ni-plating for forming a surface preferable for chemical conversion is 1 to 50 $mg/m^2$. If the amount of iron- or Ni-plating is less than 1 $mg/m^2$, it is too small and variations in chemical conversion crystals occur, while if over 50 $mg/m^2$, the iron- or Ni-plating effect becomes saturated and the effect of the increase in costs becomes greater, so this is not preferable.

Furthermore, it is preferable to wash the surface of the steel sheet between the pickling and iron- or Ni-plating and/or after the iron- or Ni-plating so as to prevent chemicals from remaining on the steel sheet surface and deteriorating the surface quality.

Furthermore, the pickling facility and iron- or Ni-plating facility are preferably connected at the annealing furnace outlet side of a continuous annealing furnace or a joint cold rolled steel sheet/hot dip galvanized steel sheet facility having such a continuous annealing furnace from the viewpoint of shortening the process and the costs, but it is also possible to use separate facilities from the continuous annealing furnace or joint cold rolled steel sheet/hot dip galvanized steel sheet facility having such a continuous annealing furnace for the pickling and iron- or Ni-plating.

When using separate facilities for pickling and for iron- or Ni-plating, if tempering by a continuous annealing furnace or joint cold rolled steel sheet/hot dip galvanized steel sheet facility having such a continuous annealing furnace, the oxide film is destroyed by the tempering and becomes foreign matter. This leads to gloss defects, flaws, and other quality defects of the steel sheet, so it is preferable to use separate facilities for pickling and iron- or Ni-plating, then tempering.

Figure 4:
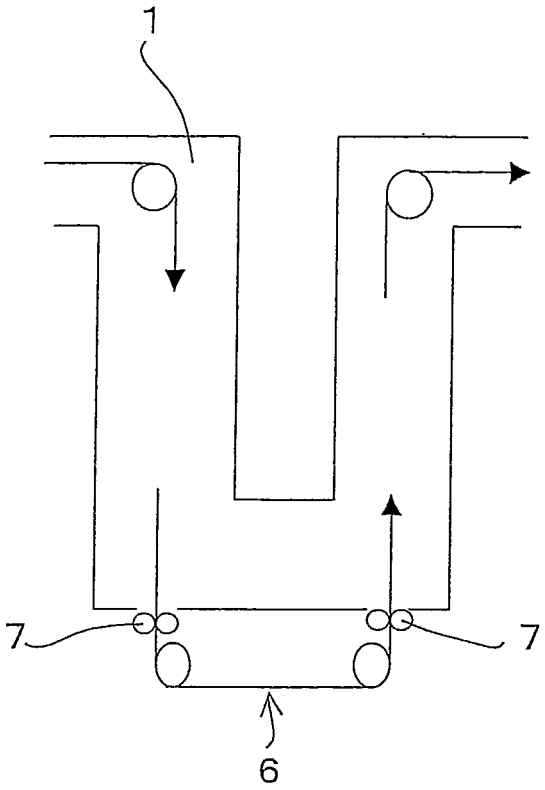
FIG. 4 is a view showing an outside sheet running facility.

At the time of gas cooling, as a simple means for exposing the steel sheet surface to an iron-oxidizing atmosphere, as shown in FIG. 4, it is possible to provide an outside sheet running unit 6 in the middle of the cooling zone in the range of steel sheet temperature of 250 to 600° C. In this way, if exposing steel sheet outside of the jet cooling furnace 1, it is possible to more reliably oxidize the iron on the steel sheet surface and form an oxide film of iron sufficient for being removed together by the Si or Mn or other oxide film by the subsequent pickling.

Furthermore, it is preferable to install a seal roll or other seal device 7 to cut off the atmosphere in the furnace from the outside at the part where the steel sheet leaves the jet cooling furnace 1 or the part where it returns to the furnace.

While not shown in FIG. 3 and FIG. 4, by pickling the sheet where it leaves the annealing furnace and pickling and removing the Si or Mn or other oxide films together with the iron oxide film, then iron- or Ni-plating it, a high strength cold rolled steel sheet excellent in chemical convertibility can be obtained.

Figure 5:
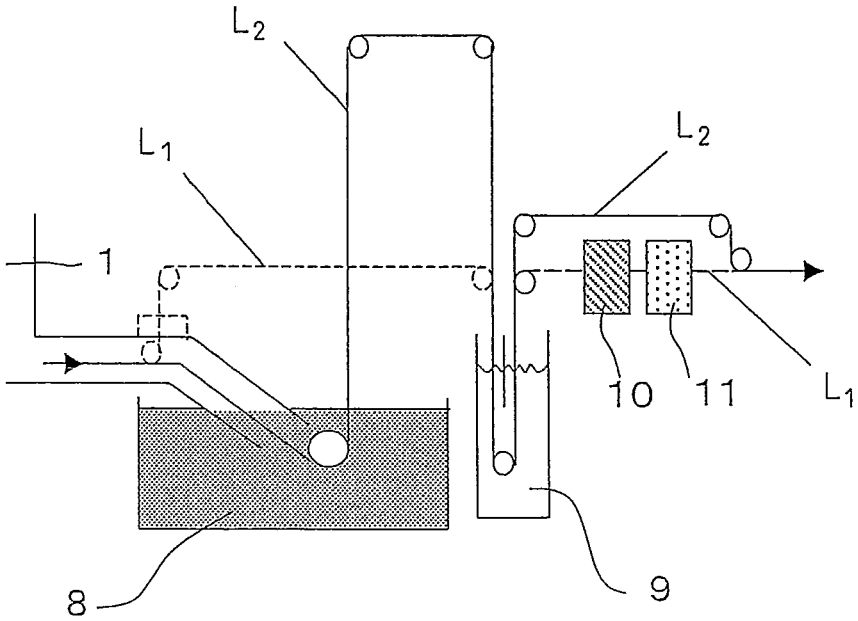
FIG. 5 is a view showing principal parts of a joint cold rolled steel sheet/hot dip galvanized steel sheet facility.

The case of working the method of exposing a steel sheet outside of the furnace in the middle of the cooling zone at a steel sheet temperature of 250 to 600° C. by a joint cold rolled steel sheet/hot dip galvanized steel sheet facility having such a continuous annealing furnace is shown in FIG. 5. Reference numeral 8 indicates a hot dip galvanization pot placed at the outlet of the jet cooling furnace 1, 9 indicates a water quench tank, 10 indicates a pickling facility, and 11 indicates a plating facility (for example, Ni plating facility).

When performing the hot dip galvanization, the steel sheet is run along the galvanized steel sheet pass line $L_2$ shown by the solid line, but when using a joint cold rolled steel sheet/hot dip galvanized steel sheet facility having such a continuous annealing furnace to anneal a cold rolled steel sheet, as shown by the broken line, the steel sheet is made to bypass the hot dip galvanization pot 8 and run along the steel sheet pass line $L_1$ after the jet cooling furnace 1.

In the past, this bypass part was also filled with a furnace atmospheric gas the same as the annealing furnace to prevent oxidation of the steel sheet and was cut off from the outside air, but in the present invention, as shown in FIG. 5, the steel sheet is run outside of the furnace at the bypass part to form an iron oxide film sufficient for removal together with the Si or Mn or other oxide film by the later pickling.

Figure 6:
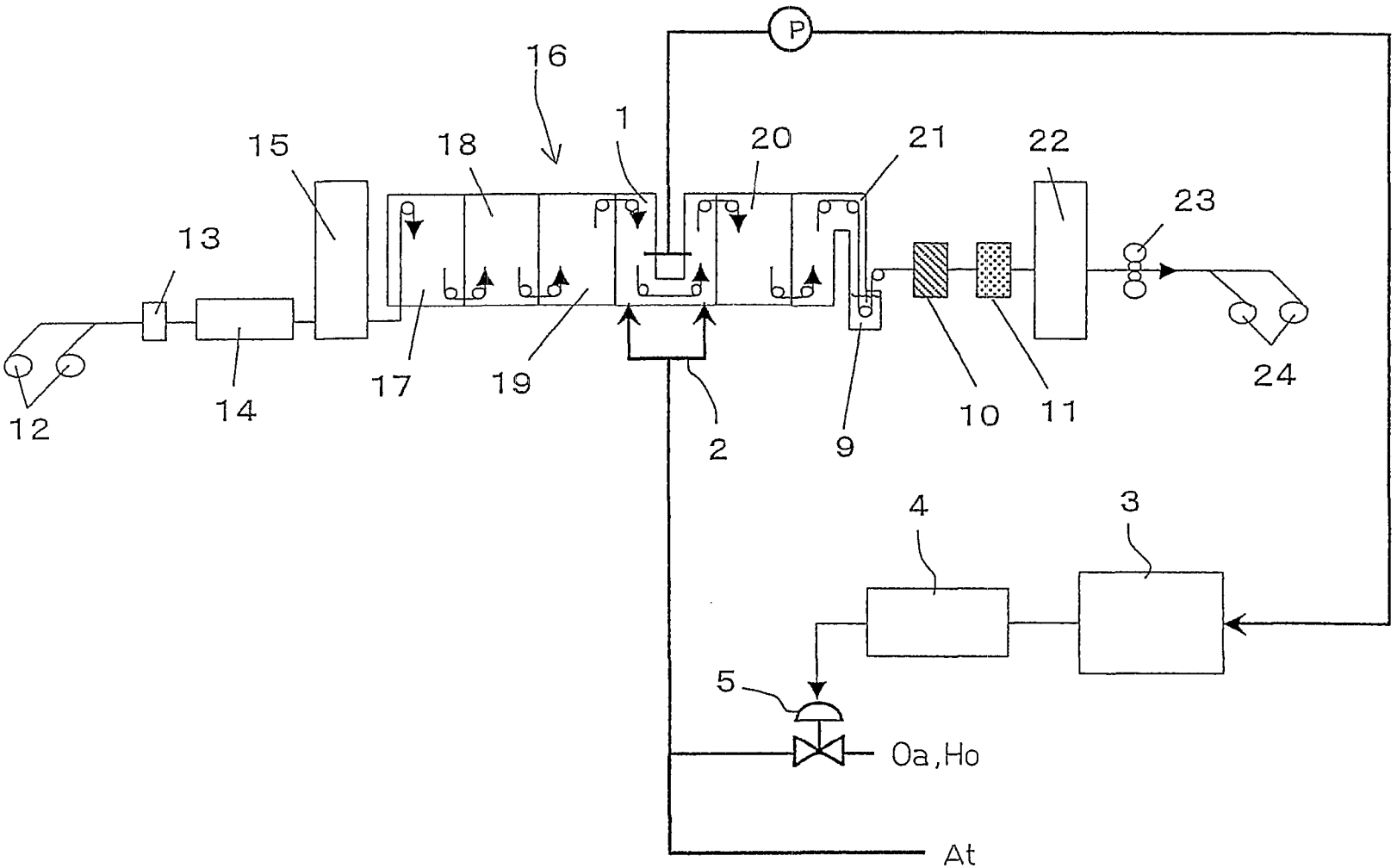
FIG. 6 is a view showing the configuration of a facility combining a gas supply facility with a continuous annealing furnace.

FIG. 6 shows the configuration of a continuous annealing furnace and shows the configuration of a facility including the gas supply facility 2 shown in FIG. 2. The steel sheet pulled out from the payoff reel 12, passes through a welder 13, inlet side washing apparatus 14, and inlet side looper 15, and enters the continuous annealing furnace 16.

The continuous annealing furnace 16 is comprised of a heating furnace 17, soaking furnace 18, slow cooling furnace (for example, gas cooling) 19, gas cooling type jet cooling furnace 1, averaging furnace 20, and final cooling furnace 21, but sometimes there is no averaging furnace 20.

Furthermore, at the outlet side of the continuous annealing furnace 16, a water quench tank 9, pickling facility 10, plating facility 11, outlet side looper 22, tempering mill 23, and tension reel 24 are successively arranged.

Note that as the plating facility, an Ni-plating facility may be used, further, an iron-plating facility may be used. Further, the gas supply facility 2 shown in FIG. 3 is provided in the jet cooling furnace 1.

Figure 7:
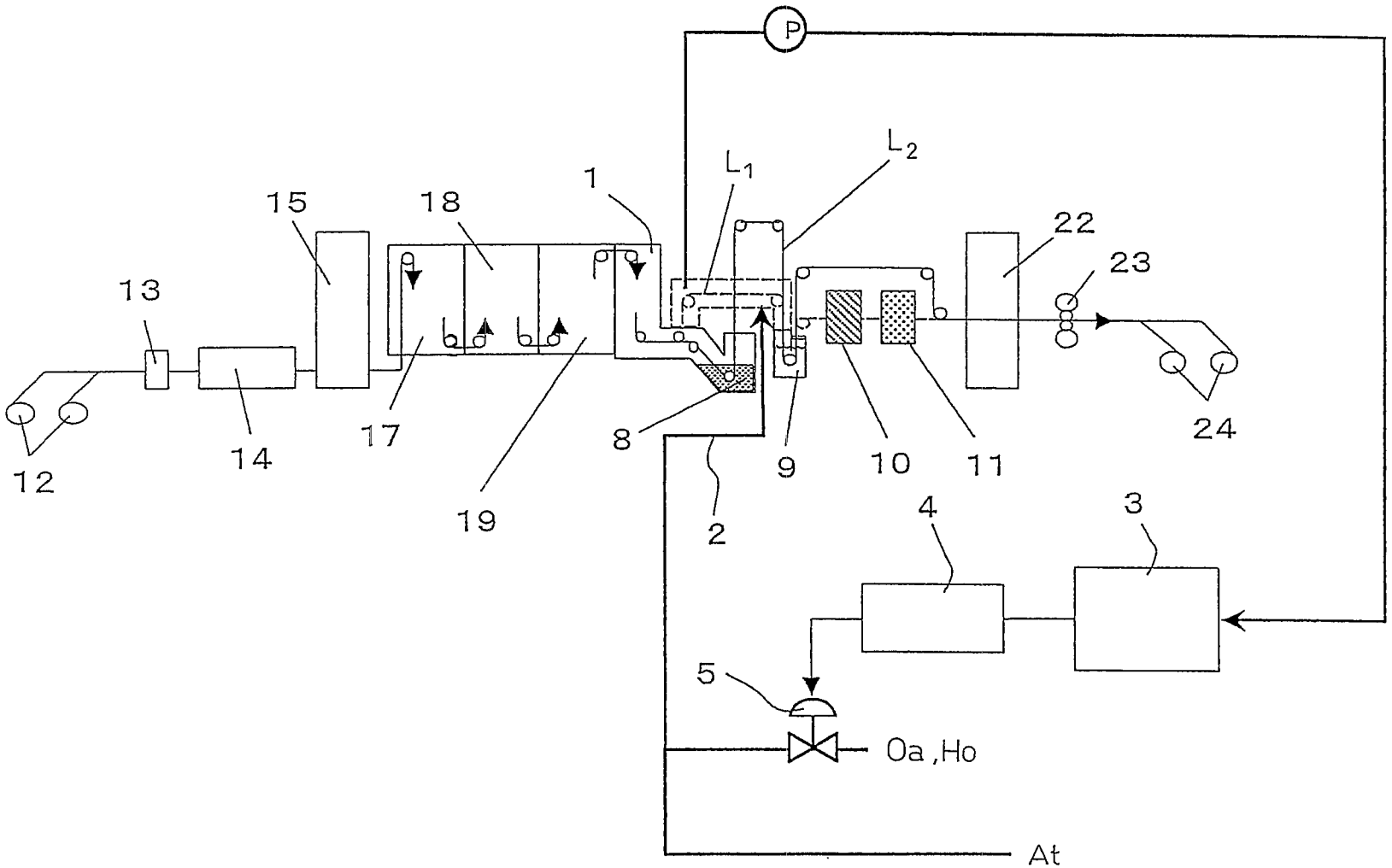
FIG. 7 is a view showing the overall configuration of a facility comprised of a joint cold rolled steel sheet/hot dip galvanized steel sheet facility in which a gas supply facility is incorporated.

FIG. 7 shows the overall configuration of a facility comprised of a joint cold rolled steel sheet/hot dip galvanized steel sheet facility having a continuous annealing furnace in which a gas supply facility 2 shown in FIG. 3 is incorporated. After the jet cooling furnace 1, as shown by the broken line, the steel sheet is run while bypassing the hot dip galvanization pot 8 so as to supply oxygen, air Oa, or water vapor Ha to the ambient atmosphere of the steel sheet in the range of steel sheet temperature of 600 to 250° C.

In the case of any of the facilities shown in FIG. 6 and FIG. 7, it is preferable to further provide a facility P for measuring the oxygen concentration or dew point in the furnace and to provide a control device 4 for controlling the supply of atmospheric gas containing oxygen or water vapor from the measurement results.

Figure 8:
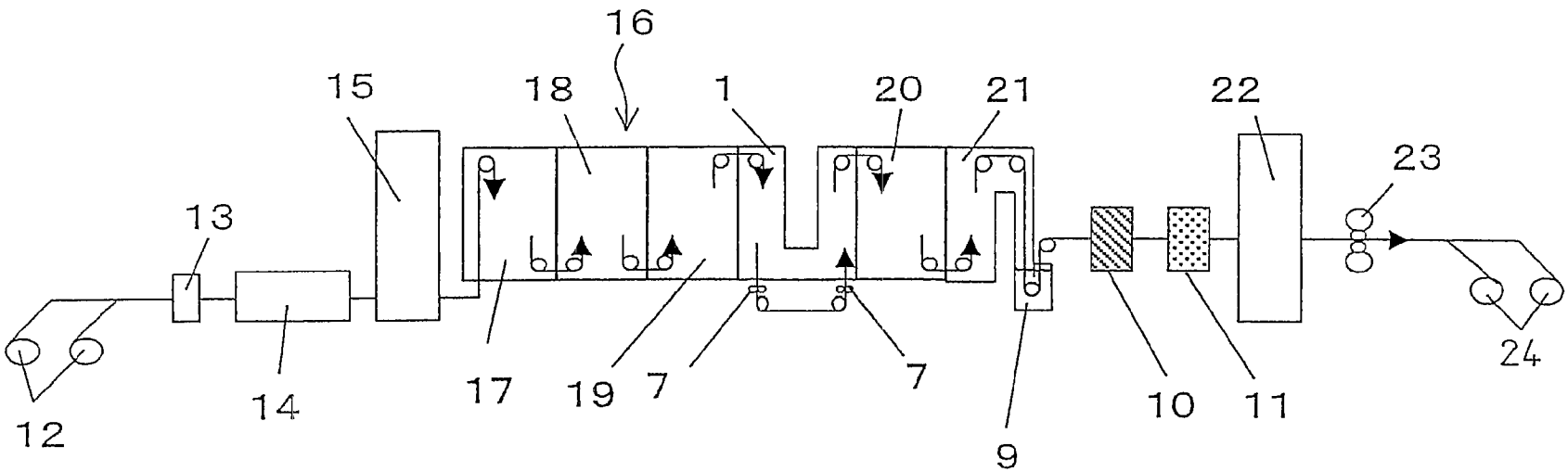
FIG. 8 is a view showing the configuration of a facility combining an outside sheet running unit with a continuous annealing furnace.

FIG. 8 shows the configuration of a facility combining the outside sheet running unit 6 shown in FIG. 4 with a continuous annealing furnace.

Figure 9:
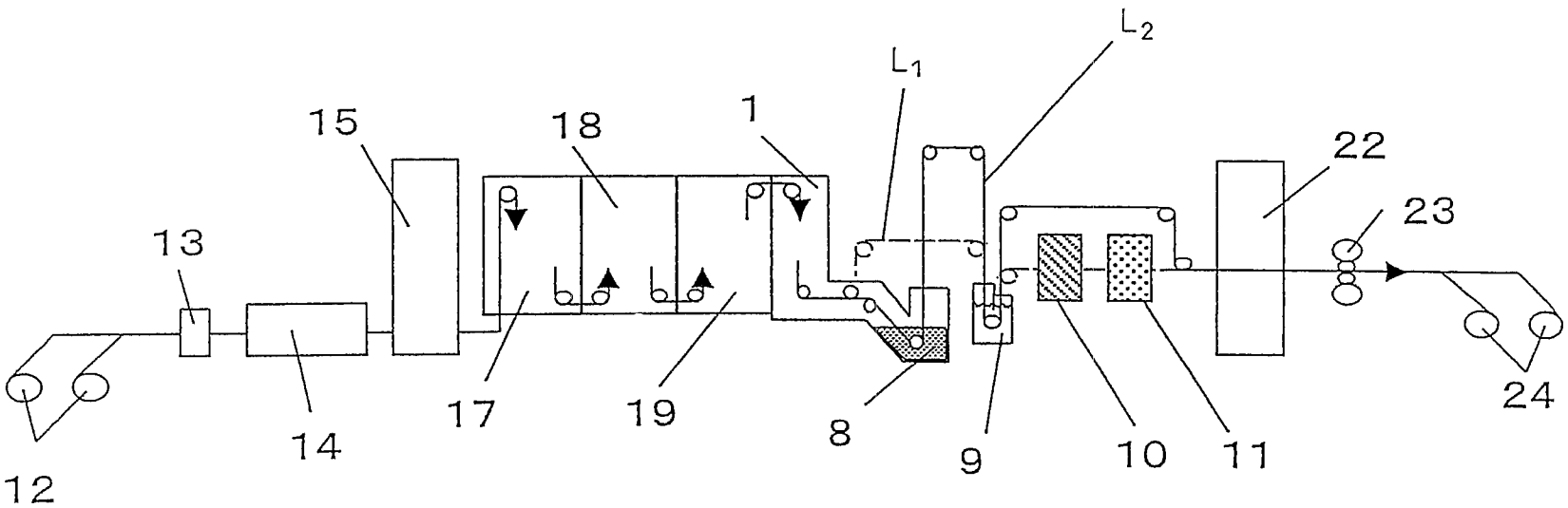
FIG. 9 is a view showing the overall configuration of a joint cold rolled steel sheet/hot dip galvanized steel sheet facility in which a bypass line is incorporated.

FIG. 9 shows the overall configuration of a facility comprised of a joint cold rolled steel sheet/hot dip galvanized steel sheet facility having a continuous annealing furnace into which the bypass line shown in FIG. 5 is incorporated.

After the jet cooling furnace 1, as shown by the broken line, the steel sheet is made to bypass the hot dip galvanization pot 8 and run along the steel sheet pass line to bring the steel sheet into contact with the outside air in the range of steel sheet temperature of 600 to 250° C. and form an iron oxide film sufficient for removal with the Si or Mn or other oxide film by subsequent pickling.

As explained above, there are various types of apparatuses for oxidizing steel sheet in the range of a steel sheet temperature of 250 to 600° C.

However, in each case, by deliberately exposing the steel sheet to an oxidizing atmosphere at the temperature, making the Si and Mn of course and also the iron at the surface layer part of the steel sheet oxidize, and removing the Si or Mn or other oxide film together with the iron oxide film of the steel sheet surface by the pickling when the sheet leaves the annealing furnace, it is possible to obtain high strength cold rolled steel sheet with a good chemical convertibility free of "bald spots" even if the Si, Mn, or other content is high.

The present invention is particularly effectively in the case of a high content of, by mass %, Si of 1.0 to 2.0% and/or Mn of 2.0 to 3.0%. Even if Si is less than 1.0% and/or Mn is less than 2.0%, of course the effect is expressed, but it is excessive.

In the prior art as well, it is possible to remove the Si and Mn oxide films to obtain a high strength cold rolled steel sheet excellent in chemical convertibility, so in the present invention, the lower limit of Si is made 1.0% and the lower limit of Mn is made 2.0%.

Regarding the upper limits of Si and Mn, even if the strength is improved, the balance with the ductility and other material conditions becomes poor, so the upper limit of Si is made 2.0% and the upper limit of Mn is made 3.0%.

Elements other than Si and Mn are adjusted in accordance with user demands for surface quality, internal defects, tensile strength, elongation, local ductility, hole expansivity, impact resistance, weldability, prevention of deterioration of the material quality at the weld zone, bake hardenability, aging, hot pressability, etc.

For example, in addition to Si and Mn, the steel may contain, by mass %, C: 0.01 to 0.3%, P: 0.0001 to 0.15%, S: 0.0001 to 0.02%, Al: 0.001 to 0.4%, and N: 0.0002 to 0.02% and have a balance of Fe and unavoidable impurities and may contain, in accordance with the required characteristics, one or more of Ti, Nb, V, Zr, W, Mo, Cr, Ni, Cu, Ca, REM, B, Mg or La, Ce, and other lanthanoid-based elements in the range of 0.0001 to 1%.

Furthermore, in continuous annealing furnace or a joint cold rolled steel sheet/hot dip galvanized steel sheet facility having such a continuous annealing furnace, usually, to prevent oxidation of the steel sheet, the furnace is filled with an inert gas mainly comprised of nitrogen etc. and the furnace is sealed and cut off from the outside air.

As this sealing means, the cooling method from the high temperature region is not limited to mist cooling, water dip cooling, gas cooling, effusion cooling, cooling pipe cooling, and roll cooling. In the past, it was known to place a seal device using water serving also for final cooling called "water quenching" at the outlet of the annealing furnace.

The final cooling here is cooling the steel sheet temperature by water from about 250° C. to ordinary temperature to about 80° C. Since water is used for cooling, the iron at the surface of the steel sheet is also oxidized and an oxide film of iron is formed, but in both the case of the present invention and in the prior art, the formation of an oxide film of iron by this water quenching does not govern the chemical convertibility.

The reason is believed to be that, unlike the case of the present invention, in water quenching, if the steel sheet temperature is less than 250° C., the formation of the iron oxide film is extremely small and is not a thick iron oxide film removed together with the Si or Mn or other oxide film like the present invention.

EXAMPLES

The inventors used four types of high strength steel sheet of the steel types A to D to run tests. The annealing was all carried out using a continuous annealing furnace under common conditions of annealing conditions (85° C.-60 sec, 10% hydrogen-bal. nitrogen, dew point-40° C.) and gas cooling conditions (5% hydrogen-bal. nitrogen, dew point-60° C.). Further, the oxidation conditions, pickling conditions, and plating conditions are summarized in Table 1.

Steel Type A: Si: 0.7%, Mn: 2.8%
Steel Type B: Si: 1.0%, Mn: 1.8%
Steel Type C: Si: 1.3%, Mn: 1.2%
Steel Type D: Si: 1.8%, Mn: 1.5%

TABLE 1

| | | Oxidation conditions | Pickling conditions | Plating |
|---|---|---|---|---|
| Example | 1 | 3% hydrogen-bal. nitrogen, dew point 30° C. | 80° C. A pickling by 5%-hydrochloric acid Dipping for 5 sec | Ni-plating |
| | 2 | 0.1% hydrogen-bal. nitrogen, dew point 50° C. | | |
| | 3 | atmosphere, dew point 5° C. | | |
| Comparative Example | 4 | 3% hydrogen-bal. nitrogen, dew point −50° C. | | |
| | 5 | 10% hydrogen-bal. nitrogen, dew point −20° C. | | |

Figure 10:
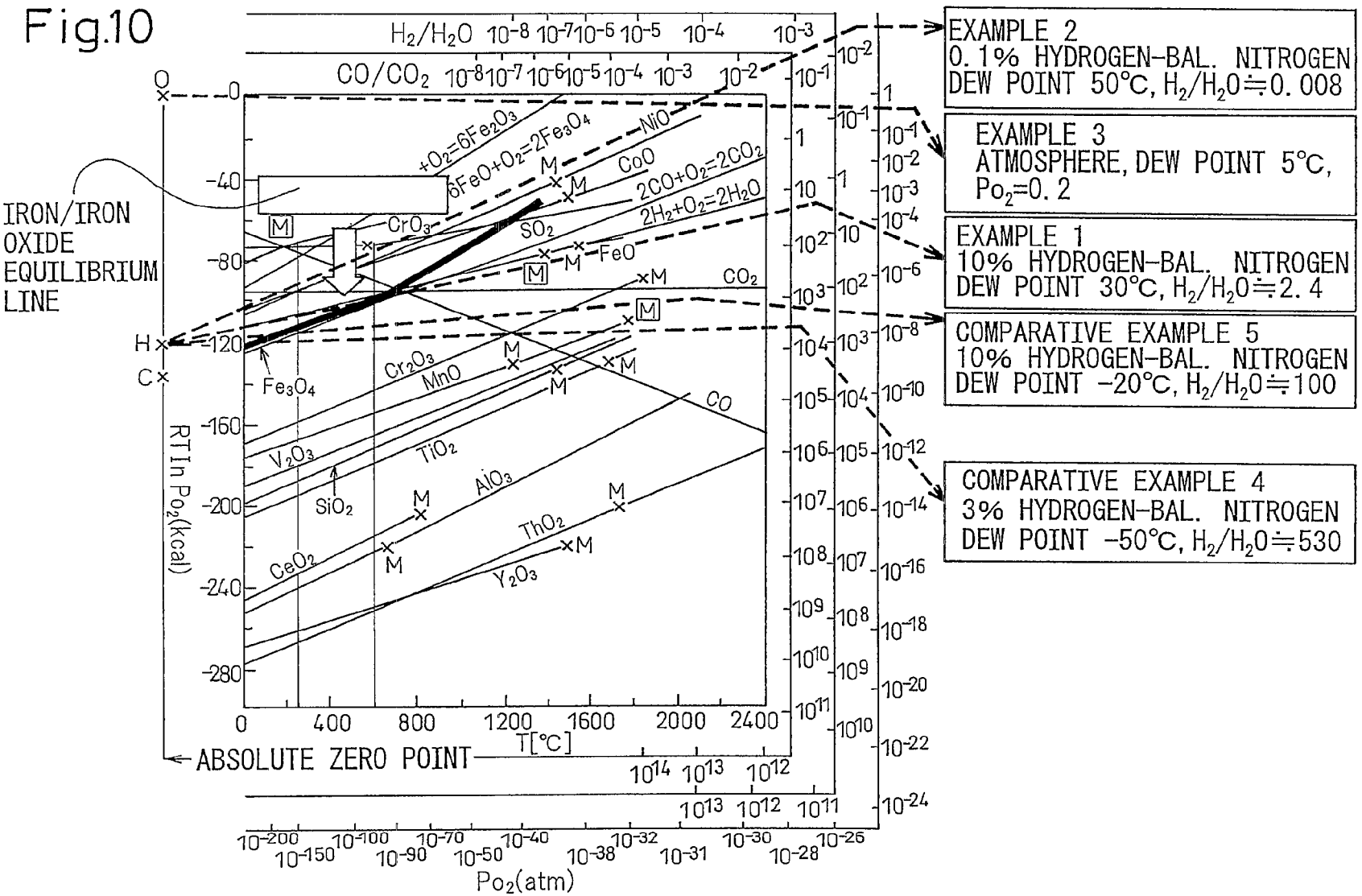
FIG. 10 is a view showing oxidation conditions of examples and comparative examples.
Figure 11:
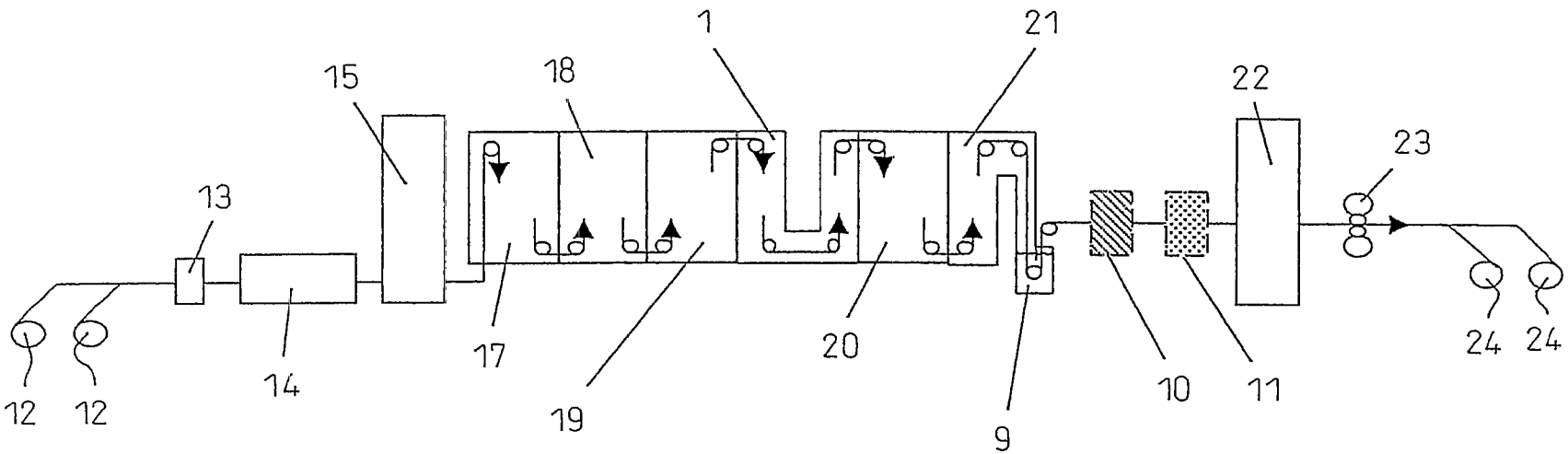
FIG. 11 is a view showing a conventional continuous annealing furnace facility.
Figure 12:
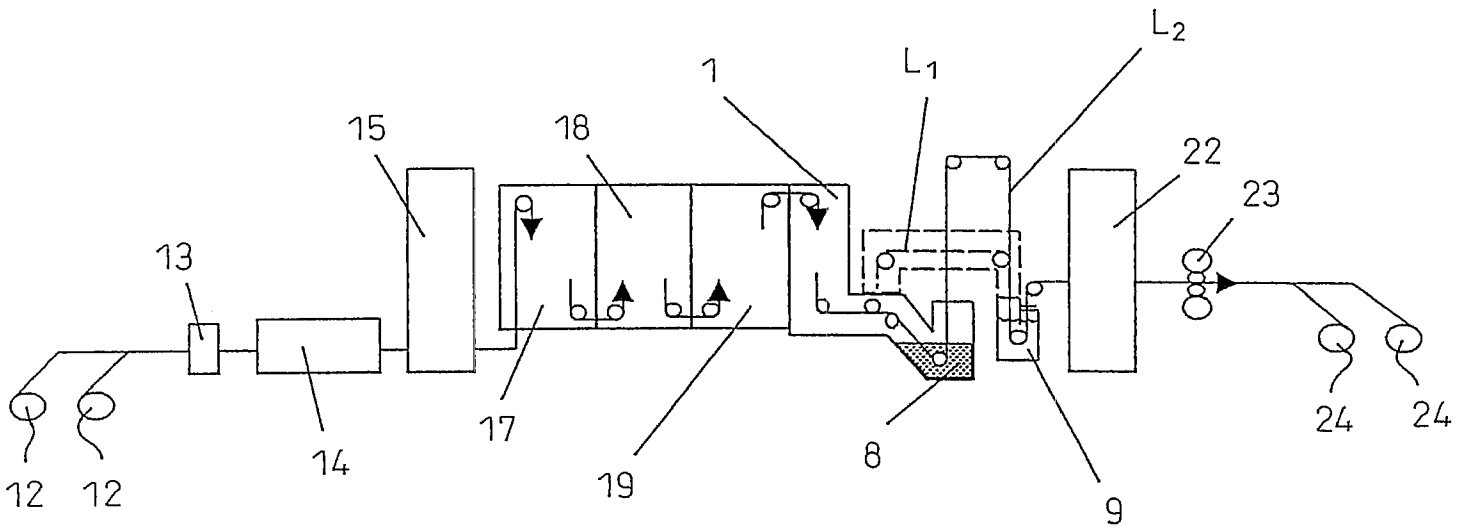
FIG. 12 is a view showing a conventional joint cold rolled steel sheet/hot dip galvanized steel sheet facility having a continuous annealing furnace.
Figure 13:
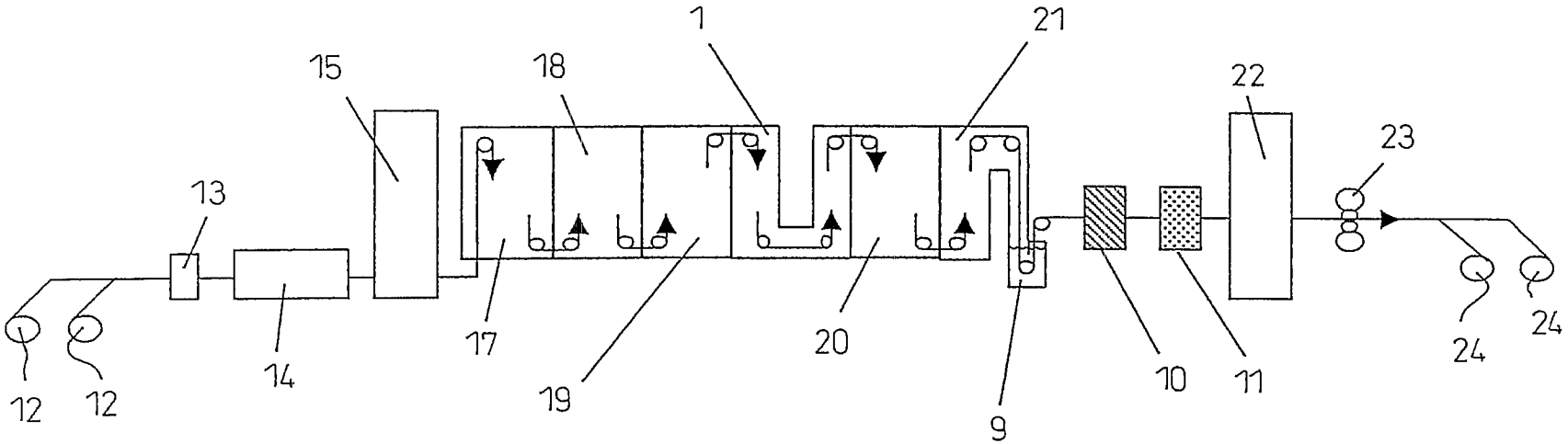
FIG. 13 is a view showing a facility for pickling and Ni-plating at the outlet side of a conventional annealing furnace.
Figure 14:
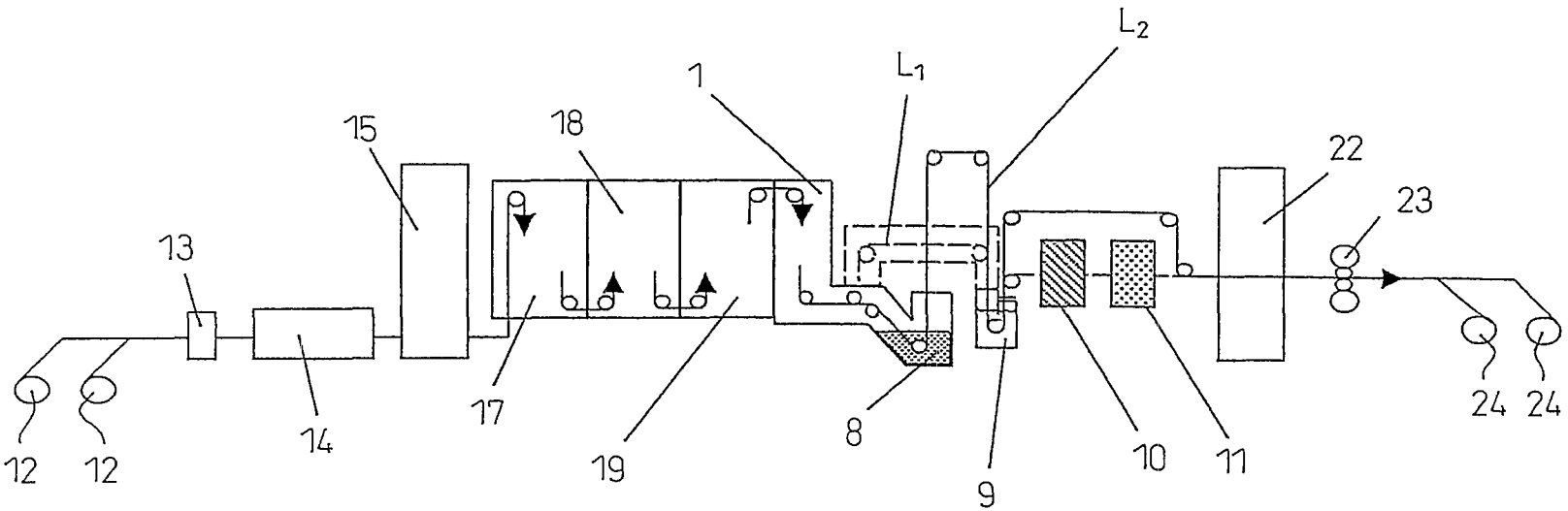
FIG. 14 is a view showing a facility for pickling and Ni-plating at the outlet side of a conventional joint cold rolled steel sheet/hot dip galvanized steel sheet facility.

Note that the positions of oxidation conditions of examples and comparative examples are shown by the broken lines in FIG. 10. When the intersecting points of these broken lines and the temperature (250 to 600° C.) are above the iron/iron oxide equilibrium line, the iron is oxidized, while when they are below them, the iron is reduced.

Example 1 to Example 3 all have intersecting points positioned below the iron/iron oxide equilibrium line in the range of 250° C. to 600° C. Under these conditions, oxidation occurs and iron oxide is formed.

Further, in Comparative Example 4 and Comparative Example 5, conversely the intersecting points are positioned below the iron/iron oxide equilibrium line. Under these conditions, iron oxides are reduced and the iron is present as iron alone.

The inventors changed the types of steel, oxidation conditions, oxidation sheet temperature, and Ni-plating amount to produce high strength cold rolled steel sheet, evaluated the appearance after chemical conversion, and measured the P ratio. The results are summarized in Table 2.

Here, in the evaluation of the appearance after chemical conversion, samples with no "bald spots" and with uniform grains were evaluated as "Good" while samples with "bald spots" were evaluated as "Poor".

The P ratio is the X-ray diffraction intensity ratio P/(P+H) of the phosphophyllite (100) plane P and hopeite (020) plane H. 0.85 or more was deemed "◎ (very good)", 0.80 to less than 0.85 "○ (good)", and less than 0.80 "X (poor)".

Examples 1 to 11 are invention examples. All are good in chemical convertibility. On the other hand, in Comparative Examples 12, 13, 15, 16, and 18, the iron was not deliberately oxidized, so chemical conversion defects occurred due to Si or Mn residual oxides.

In Comparative Example 14, while the sheet was deliberately oxidized, the oxidation temperature was too high and the oxides became extremely thick, whereby the oxide film failed to be removed in the subsequent pickling, but remained and chemical conversion defects resulted.

In Comparative Example 17, the furnace removal temperature was too low, so oxidation did not proceed and as a result Si or Mn oxides remained without being removed and chemical conversion defects occurred.

In Comparative Examples 19 and 20, the steel was not Ni-plated after the pickling, so while the chemically converted film itself had phosphophyllite precipitating, a large number of "bald spots" formed and the chemical convertibility was poor.

TABLE 2

| | No. | Steel type | Oxidation conditions | Oxidized sheet temperature (° C.) | Ni-plating | Appearance | P ratio |
|---|---|---|---|---|---|---|---|
| Inv. ex. | 1 | A | 1 | 250 | 3 mg/m$^2$ | ○ | ○ |
| | 2 | A | 2 | 450 | 10 mg/m$^2$ | ○ | ◎ |
| | 3 | A | 3 | 600 | 50 mg/m$^2$ | ○ | ○ |
| | 4 | B | 1 | 350 | 20 mg/m$^2$ | ○ | ◎ |
| | 5 | B | 2 | 300 | 50 mg/m$^2$ | ○ | ◎ |
| | 6 | B | 3 | 400 | 30 mg/m$^2$ | ○ | ◎ |
| | 7 | C | 1 | 500 | 15 mg/m$^2$ | ○ | ◎ |
| | 8 | C | 2 | 300 | 10 mg/m$^2$ | ○ | ◎ |
| | 9 | C | 3 | 350 | 25 mg/m$^2$ | ○ | ◎ |
| | 10 | D | 1 | 450 | 10 mg/m$^2$ | ○ | ◎ |
| | 11 | D | 3 | 600 | 40 mg/m$^2$ | ○ | ○ |
| Comp. ex. | 12 | A | 4 | 350 | 10 mg/m$^2$ | X | X |
| | 13 | A | 5 | 650 | 25 mg/m$^2$ | X | X |
| | 14 | A | 3 | 850 | 25 mg/m$^2$ | X | X |
| | 15 | B | 4 | 400 | 30 mg/m$^2$ | X | X |
| | 16 | B | 5 | 700 | 15 mg/m$^2$ | X | X |
| | 17 | B | 2 | 150 | 10 mg/m$^2$ | X | X |
| | 18 | C | 4 | 150 | 10 mg/m$^2$ | X | X |
| | 19 | C | 3 | 300 | None | X | ○ |
| | 20 | D | 3 | 400 | None | X | ○ |

As shown in the above data, according to the present invention, to increase the strength, even when increasing the content of Si, Mn, etc. in the steel, it is possible to produce high strength cold rolled steel sheet excellent in chemical convertibility.

INDUSTRIAL APPLICABILITY

The present invention, as explained above, enables the production of high strength cold rolled steel sheet having a high content of Sn, Mn, etc. of the steel sheet and excellent in chemical convertibility. Therefore, in particular it contributes to the expansion of application of high strength steel sheet in the auto industry.

The invention claimed is:

1. A method of production of a cold rolled steel sheet excellent in chemical convertibility comprising using;

a continuous annealing furnace where a cooling method of a cooling zone including part of all of a temperature range of the steel sheet of 600 to 250° C. following heating for recrystallization is one or more of gas cooling, effusion cooling, and cooling pipe cooling, or a joint cold rolled steel sheet/hot dip galvanized steel sheet facility having such a continuous annealing furnace, to continuously anneal cold rolled steel sheet and produce the cold rolled steel sheet, said method characterized by;

exposing the surface of the steel sheet in said steel sheet temperature range to an atmospheric gas of a ratio of hydrogen partial pressure and water vapor partial pressure ($H_2/H_2O$) of 0.008 to 2.4 so as to oxidize said surface, pickling the sheet by an acid fluid containing 1 to 20 weight % of hydrochloric acid or sulfuric acid in a temperature range between 60° C. to 95° C. at the annealing furnace outlet side so the sheet has no bald spots and has a P ratio of 0.80 or more, then iron- or Ni-plating the sheet to 1 to 50 mg/m$^2$, wherein the P ratio is the X-ray diffraction intensity ratio P/(P+H) of the phosphophyllite (100) plane P and hopeite (020) plane H.

2. The method of production of the cold rolled steel sheet excellent in chemical convertibility as set forth in claim 1, said method characterized by;

supplying the inside of the furnace in said steel sheet temperature range with atmospheric gas containing oxygen or water vapor, measuring the oxygen concentration or dew point in the furnace, controlling the amount of supply of the atmospheric gas containing the oxygen or water vapor from the measurement results, pickling the sheet at the annealing furnace outlet side, then iron- or Ni-plating the sheet to 1 to 50 mg/m$^2$.

3. The method of production of the cold rolled steel sheet excellent in chemical convertibility as set forth in claim 1, characterized by making the steel sheet run outside of the furnace so as to expose the surface of the steel sheet to an iron oxidizing atmosphere at part or all of the said 600 to 250° C. steel sheet temperature range following heating for recrystallization.

4. The method of production of the cold rolled steel sheet excellent in chemical convertibility as set forth in any one of claims 1 to 3, characterized in that said cold rolled steel sheet contains, by mass %, Si: 1.0 to 2.0% and/or Mn: 2.0 to 3.0%.

* * * * *